US006520220B2

(12) United States Patent
Durkin et al.

(10) Patent No.: US 6,520,220 B2
(45) Date of Patent: Feb. 18, 2003

(54) SYSTEM FOR SAFE AND CONTROLLED FILLING OF DISPENSERS

(76) Inventors: David Durkin, 512 Vanderbilt Ave., Virginia Beach, VA (US) 23451; John R. Friedrichs, 3112 Hickorywood Ct., Virginia Beach, VA (US) 23456

( * ) Notice: Subject to any disclaimer, the term of this patent is extended or adjusted under 35 U.S.C. 154(b) by 0 days.

(21) Appl. No.: 09/825,858

(22) Filed: Apr. 5, 2001

(65) Prior Publication Data

US 2002/0007864 A1 Jan. 24, 2002

Related U.S. Application Data

(60) Provisional application No. 60/194,629, filed on Apr. 5, 2000.

(51) Int. Cl.[7] ..... B67C 3/02

(52) U.S. Cl. ..... 141/94; 141/18; 141/67; 141/192; 141/196

(58) Field of Search ..... 141/18, 20, 67, 141/94, 192, 196, 311 R; 222/638, 642; 53/79, 88

(56) References Cited

U.S. PATENT DOCUMENTS 4,197,884 A * 4/1980 Maran ..... 141/113
4,407,340 A * 10/1983 Jensen et al. ..... 141/159
4,583,346 A * 4/1986 Kameda ..... 141/51
4,583,664 A * 4/1986 Bayat ..... 222/61

* cited by examiner

*Primary Examiner*—Timothy L. Maust
(74) *Attorney, Agent, or Firm*—Miles & Stockbridge P.C.; John C. Kerins; Edward J. Kondracki

(57) ABSTRACT

A gas/liquid transfer device for delivering a fixed quantity of pressurized gas/liquid to a dispensing device including a fixed volume chamber for receiving the pressurized gas/liquid, the chamber being in fluid connection with a system of controllable filling and emptying valves and a discharge connector. The discharge connector is disposed downstream of the emptying valve is arranged to be operatively coupled by an operator to a hand held dispensing device. The discharge connector is tamper-proof and configured to prevent a fixed quantity of pressurized gas to be discharged without the dispensing device being attached to the discharge connector. The timer is configured to impose a predetermined time interval between successive transfers of the pressurized gas/liquid.

13 Claims, 2 Drawing Sheets

SYSTEM FOR SAFE AND CONTROLLED FILLING OF DISPENSERS

CROSS-REFERENCE TO RELATED APPLICATIONS

The present application is related to provisional application Ser. No. 60/194,629, filed Apr. 5, 2000, hereby incorporated herein by reference.

BACKGROUND OF THE INVENTION

1. Field of the Invention

The present invention relates to systems for charging pressurized cylinders, and more particularly, to a system and method for safely delivering a controlled quantity nitrous oxide gas/liquid to cylinders used to pressurize a device for dispensing food under pressure.

2. Description of Related Art

Numerous compositions to be dispensed as foams, liquids or mixtures have been packaged in pressurized containers. Exemplary compositions include shaving creams and lathers, floor and automobile cleaning and polishing compositions, and food products such as cheese spreads, mayonnaise, whipped cream and the like. In the food industry, pressurized dispensers include either a pressurized aerosol can which holds both the food product and a propellant, or in a two-piece arrangement including a refillable food product storage container connected to a separate, replaceable, miniature gas/liquid propellant bottle, or cylinder. Both of these arrangements have been applied, together with the use of nitrous oxide, to the pressure dispensing of whipped cream food products, for example. The nitrous oxide propellant is stored in gaseous or liquid/gas form in the miniature cylinder.

Both the aerosol can and miniature gas cylinder component of the two-piece arrangement are non-refillable consumables, which present disadvantages in terms of both replacement cost and disposal. The accumulated cost of the disposable pressurized container can be substantial relative to the value of the delivered food product. Used aerosol containers and miniature pressurized cylinders may contain residual gas/liquid pressure and as a result, can be hazardous when crushed or exposed to elevated temperatures. Moreover, improper use and abuse of nitrous oxide is a health hazard, and miniature cylinders filled with that particular gas/liquid have been known to be attractive to both youth and adults, with deleterious effects resulting from inhalation of the gas.

Accordingly, there is a need for a delivery system configured for safe delivery of a predetermined amount of pressurized gas/liquid to a refillable dispensing device. The gas/liquid delivery system needs to be safe and easy to operate and configured both to avoid unintended discharge outside a dispensing device and to prevent overpressurization of the dispensing device and unauthorized access to substantial quantities of the gas/liquid.

SUMMARY OF THE INVENTION

The above and other needs are obtained by providing a gas/liquid transfer device for safely delivering a controlled quantity of gas/liquid to a hand held dispensing device. The transfer device includes a fixed volume chamber and a timing mechanism for controlling the transfer from a storage cylinder to the chamber of a predetermined volume of the gas/liquid. The fixed volume chamber is in fluid connection with a filling valve disposed upstream of the chamber and an emptying valve downstream of the chamber. Actuation of both valves is controlled by the timing mechanism, which controls the amount of time the valves are opened. A discharge connector disposed downstream of the emptying valve is arranged to be operatively coupled by an operator to a hand held dispensing device.

In operation, and after being initially charged with a quantity of gas/liquid, the gas/liquid transfer device of the present invention can be activated to deliver a predetermined volume of gas to an attached dispensing device. Upon completion of the transfer, as determined by the timer, the transfer device automatically seals the emptying valve and opens the filling valve to accept a new charge of gas/liquid from the supply cylinder. The duration of time, as controlled by the timer, is sufficient to fill the fixed volume chamber. Each filled dispensing device can be disconnected and replaced by another empty dispensing device, as desired.

The gas/liquid transfer device of the present invention includes safety features directed to prevention of the misuse of, and unauthorized access to, the gas/liquid dispensed by the device. To that end, a predetermined time interval is imposed by the timer between successive transfers of the gas/liquid, thereby preventing access to substantially continuous volumes of dispensed gas/liquid. This problem is also obviated by arranging the timing of the filling and emptying valves to prevent discharge of the gas/liquid while the transfer device is being filled. Further, the discharge connector, which is used for connecting the gas/liquid transfer device to a hand held dispensing device, is configured to be tamper resistant.

BRIEF DESCRIPTION OF THE DRAWINGS

These and other features of the present invention and the attendant advantages will be readily apparent to those having ordinary skill in the art, and the invention will be more easily understood from the following detailed description of the preferred embodiments taken in conjunction with the accompanying drawings, wherein like reference characters represent like parts throughout the several views.

DETAILED DESCRIPTION OF THE PREFERRED EMBODIMENT

The present invention is generally applicable to the safe delivery of a predetermined volume of gas, liquid, or a gas/liquid mixture, to a dispensing device configured for using the pressurized substance as a propellant for subsequent dispensing of any of a variety of food or non-food foams, liquids or extrudable mixtures. For ease of description, and without limitation, the system and method of the present invention will be herein described in terms of delivery of gas/liquid nitrous oxide to a dispensing device configured for dispensing a whipped cream food product. The embodiments described herein are envisioned as applicable to all of the aforementioned delivery modes using any suitable pressurized propellant.

Figure 1:
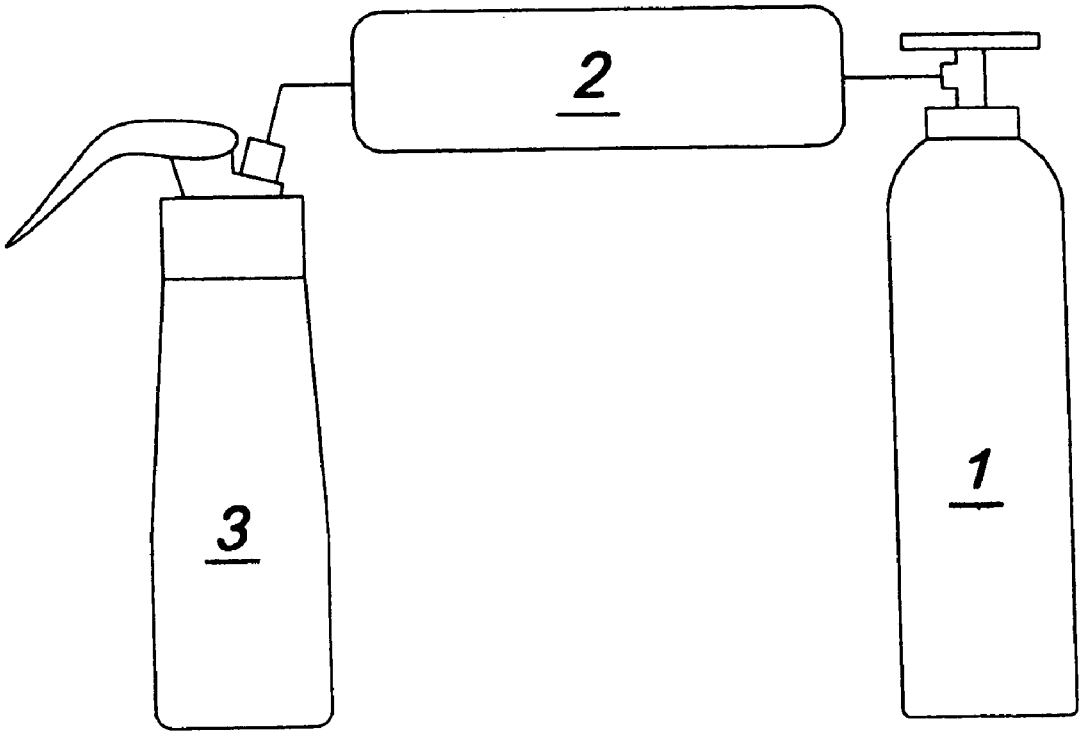
FIG. 1 is a block diagram of a gas/liquid delivery system including a gas/liquid storage cylinder, a gas/liquid transfer device, and a dispensing container according to a preferred embodiment of the present invention.

FIG. 1 is a block diagram showing a large nitrous oxide storage cylinder 1, a gas/liquid transfer device 2, and a hand held dispensing device 3 which is used to dispense, for example, whipped cream, according to the present invention. The gas/liquid transfer device 2 is fluid-connected to both storage cylinder 1 and hand held dispenser 3 for control of the flow of gas/liquid nitrous oxide from storage cylinder 1 to dispensing device 3.

Figure 2:
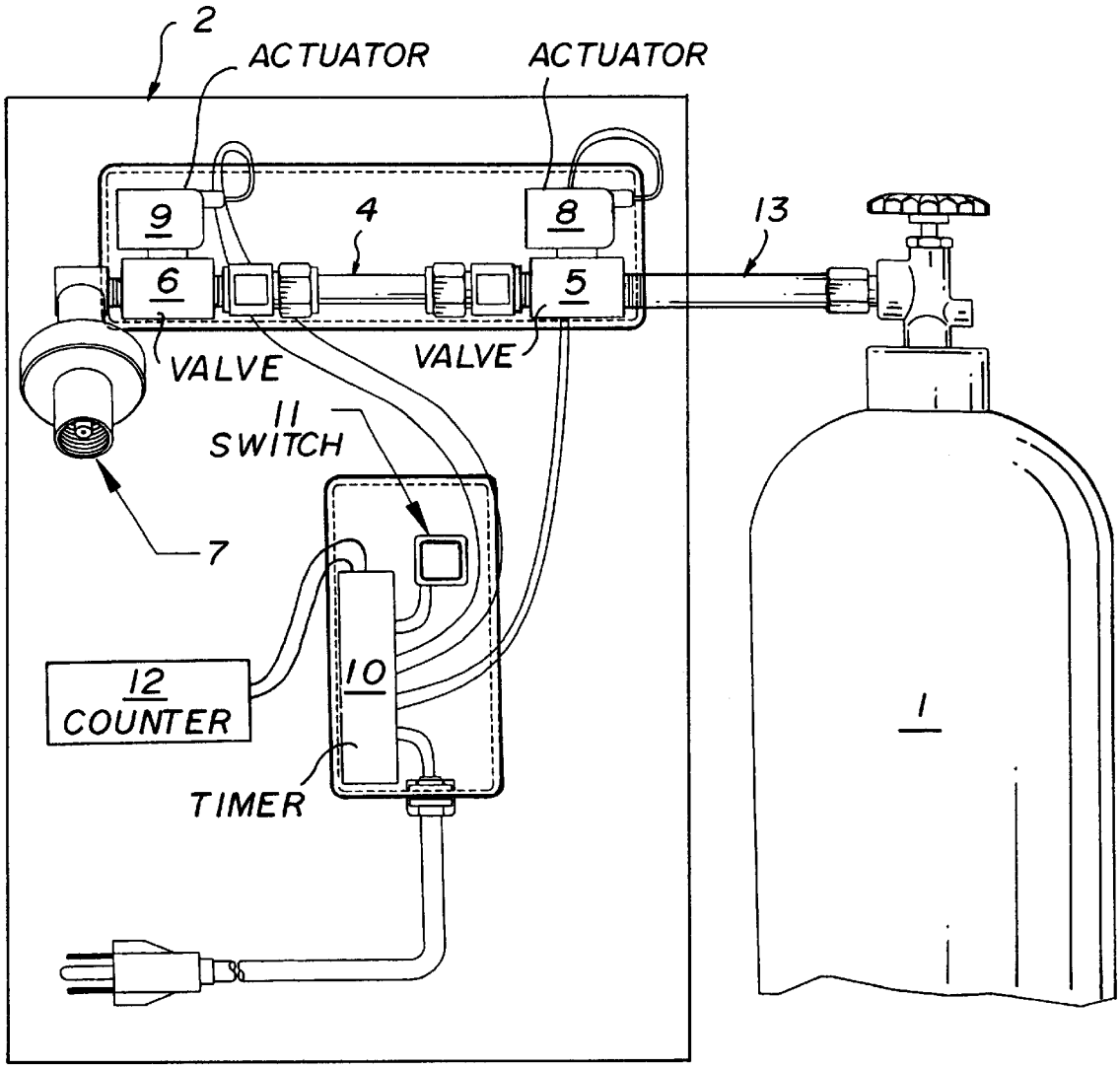
FIG. 2 is a substantially schematic illustration of the internal components of the gas/liquid transfer device shown in the block diagram of FIG. 1.

FIG. 2 is a substantially schematic illustration of the internal components of the gas/liquid transfer device 2 shown in the block diagram of FIG. 1, according to the present invention. In FIG. 2, the gas/liquid transfer device 2 is shown to include a chamber 4 of fixed internal volume, which is provided to contain a metered charge of nitrous oxide gas/liquid. Fixed volume chamber 4 is in fluid communication with a filling valve 5 disposed upstream of chamber 4, an emptying valve 6 disposed downstream of chamber 4, and a discharge connector 7 disposed downstream of emptying valve 6.

Discharge connector 7 is designed to be opened only by mechanically mating with a fitting or connector (not shown) on dispensing device 3. Discharge connector 7 is configured to be tamper-resistant, by including a seal responsive to a spring configured to apply a closing force that is sufficiently high as to deter or prevent tampering by the user. The dispensing device includes a similar spring-actuated seal. Mating of the dispensing device with discharge connector 7 requires a mating force sufficient to override the closing tension of both high-tension springs, thereby displacing both seals and thereby providing a connecting passage for the pressurized gas.

Filling valve 5 is operatively connected to a filling valve control device 8, and emptying valve 6 is operatively connected to an emptying valve control device 9. Control devices 8 and 9 preferably are electric solenoid actuators which are integrally combined with respective valves 5 and 6, although any other suitable actuator, such as, for example, a pneumatic actuator, is also suitable. Preferably, both filling valve 5 and emptying valve 6 are normally closed. Other valve arrangements which manage successive movements of gas/liquid into, and out of, the fixed volume chamber 4 are also suitable.

A timer 10 is electrically connected to an actuation switch 11 and also to both valve control devices 8 and 9. Actuation switch 11 can be a push-button switch. Timer 10 operates as a controller of the filling and emptying valves and can take the form of any known timer or controller. Timer 10 could include a logic circuit having the valve control sequence stored therein.

In the illustrated preferred embodiment, gas/liquid transfer device 2 includes a counter 12 electrically connected to timer 10 and configured to record the number of times gas/liquid transfer device 2 has been activated, thereby providing an indication of consumption of available pressurized gas/liquid remaining in storage cylinder 1. The counter 12 may preferably include a display (not shown) visible at the exterior of device 2.

Prior to operation of the gas/liquid transfer device 2, a fitting (not shown) on dispenser 3 is attached to discharge connector 7 of gas/liquid transfer device 2. Also, a fitting (not shown) on storage cylinder 1 is attached to gas/liquid transfer device 2 upstream of filling valve 5. Each fitting can be any type of known fitting suitable for gas or gas/liquid connections, although a "quick-disconnect" type fitting facilitates convenient attachment and subsequent detachment. The resulting union between storage cylinder 1 and gas/liquid transfer device 2 permits nitrous oxide gas/liquid to pass from storage cylinder 1 into gas/liquid transfer device 2. Because filling valve 5 is normally closed until opened by activation of filling valve control device 8, connection to storage cylinder 1 pressurizes a connecting pipe 13 upstream of filling valve 5.

As part of the procedure for initial hook-up of gas/liquid transfer device 2 to the large nitrous oxide storage container 1, device 2 must be initially purged of air. This is accomplished by operation of the actuation switch 11, which activates timer 10, which in turn sequentially cycles all valves and leaves device 2 fully charged and ready to deliver a volume of pressurized nitrous oxide gas/liquid to hand-held dispensing device 3. The purging step is performed before dispensing device 3 is coupled to device 2.

Subsequent operation of actuation switch 11 activates timer 10, which initiates a full cycle of operation of gas/liquid transfer device 2, beginning with the delivery of gas/liquid to the dispensing device 3. This is effected by an energization of emptying valve control device 9, thereby causing normally closed emptying valve 6 to open for a predetermined amount of time. This time period allows the trapped gas/liquid to leave fixed volume chamber 4 through discharge connector 7 and flow into the interior of hand held dispenser 3. At the end of the predetermined period of time, timer 10 de-energizes emptying valve control device 9, which causes emptying valve 6 to close, thereby leaving the discharged gas/liquid to be held at a desired pressure within dispensing device 3 and within the gas/liquid passageway downstream of closed emptying valve 6.

Upon de-energization of emptying valve control device 9, timer 10 then energizes filling valve control device 8, for opening normally closed filling valve 5 for a predetermined time to allow fixed volume chamber 4 to refill. This results in delivery of a predetermined volume of gas from storage container 1 into fixed volume chamber 4. During this time period, the timer keeps the emptying valve 6 closed and the switch 11 disabled, thereby effectively preventing any possibility of dispensing of the gas/liquid through discharge connector 7, which deters misuse of the invention and prevents continuous access to nitrous oxide gas. At the end of the predetermined period of time, filling valve control device 8 is de-energized, thereby causing filling valve 5 to close. As a result, the predetermined volume of gas/liquid is held within fixed volume chamber 4 by closed valves 5 and 6.

At this point, the operational cycle of gas/liquid transfer device 2 ends. Device 2 is charged with a supply of gas/liquid and is ready for further use in charging another dispensing device 3. In a preferred embodiment, timer 10 is set to delay subsequent fills for a predetermined period of time. This delay between successive fills prevents or inhibits misuse of the system of the present invention by preventing unauthorized access to substantially continuous availability of the nitrous oxide gas. After the delay period has elapsed, actuation switch 11 is enabled, allowing an operator to commence the charging process by operating the actuation switch. Under conditions where misuse of the system is unlikely to occur, the delay may be reduced or eliminated.

While this invention has been described in conjunction with specific embodiments thereof, it is evident that many alternative modifications and variations will be apparent to those skilled in the art. Accordingly, the preferred embodiments of the invention as set forth herein are intended to be illustrative, not limiting. Various changes may be made without departing from the true spirit and scope of the invention as defined in the following claims.

What is claimed is:

1. A gas/liquid transfer device for delivering a fixed quantity of pressurized gas/liquid to a dispensing device comprising:

a fixed volume chamber for receiving the pressurized gas/liquid, the chamber being in fluid connection with a system of controllable valves and a discharge connector, wherein the discharge connector is adapted to be operatively coupled to the dispensing device;

a timer for controlling delivery of the gas/liquid, the timer being operatively connected to the system of controllable valves; and further comprising:

a counter electrically connected to the timer, the counter being configured to record the number of times the gas/liquid transfer device has been activated, thereby providing an indication of consumption of available pressurized gas/liquid.

2. The gas/liquid transfer device of claim 1, wherein the discharge connector is configured to be tamper-resistant.

3. A gas/liquid transfer device for delivering a fixed quantity of pressurized gas/liquid to a dispensing device comprising:

a fixed volume chamber for receiving the pressurized gas/liquid, the chamber being in fluid connection with a filling valve disposed upstream of the chamber, an emptying valve disposed downstream of the chamber, and a discharge connector disposed downstream of the emptying valve, wherein the discharge connector is adapted to be operatively coupled to the dispensing device;

a filling valve control device being operatively connected to the filling valve;

an emptying valve control device being operatively connected to the emptying valve; and a timer for controlling delivery of the pressurized gas/liquid, the timer being operatively connected to the filling valve control device and the emptying valve control device.

4. The gas/liquid transfer device of claim 3, wherein the filling valve is a normally open valve and the emptying valve is a normally closed valve.

5. The gas/liquid transfer device of claim 3, wherein the discharge connector is configured to be tamper-resistant.

6. The gas/liquid transfer device of claim 3, wherein the discharge connector is configured to prevent a fixed quantity of pressurized gas to be discharged without the dispensing device being attached to the discharge connector.

7. The gas/liquid transfer device of claim 3, wherein the timer is configured to impose a predetermined time interval between successive transfers of the pressurized gas/liquid.

8. The gas/liquid transfer device of claim 3 further comprising:

a counter electrically connected to the timer, the counter being configured to record the number of times the gas/liquid transfer device has been activated, thereby providing an indication of consumption of available pressurized gas/liquid.

9. The gas/liquid transfer device of claim 3 wherein the filling valve and the emptying valve are controlled to prevent discharge of delivered gas/liquid from the fixed volume chamber during delivery of the fixed quantity of pressurized gas/liquid into the fixed volume chamber.

10. The gas/liquid transfer device of claim 1, wherein the system of controllable valves includes a filling valve and an emptying valve, and wherein the filling valve is a normally open valve and the emptying valve is a normally closed valve.

11. The gas/liquid transfer device of claim 1, wherein the discharge connector is configured to prevent a fixed quantity of pressurized gas to be discharged without the dispensing device being attached to the discharge connector.

12. The gas/liquid transfer device of claim 1, wherein the timer is configured to impose a predetermined time interval between successive transfers of the pressurized gas/liquid.

13. The gas/liquid transfer device of claim 1, wherein the system of controllable valves includes a filling valve and an emptying valve, and wherein the filling valve and the emptying valve are controlled to prevent discharge of delivered gas/liquid from the fixed volume chamber during delivery of the fixed quantity of pressurized gas/liquid into the fixed volume chamber.

* * * * *